United States Patent [19]

Pullin

[11] 4,440,222

[45] Apr. 3, 1984

[54] SIDE POCKET MANDREL WITH IMPROVED ORIENTING MEANS

[75] Inventor: William H. Pullin, Dallas, Tex.

[73] Assignee: Otis Engineering Corporation, Dallas, Tex.

[21] Appl. No.: 351,628

[22] Filed: Feb. 24, 1982

[51] Int. Cl.[3] ..... E21B 23/03

[52] U.S. Cl. ..... 166/117.5; 175/4.51

[58] Field of Search ..... 166/117.5, 240; 175/4.51

[56] References Cited

U.S. PATENT DOCUMENTS

| | | | |
|---|---|---|---|
| 2,942,671 | 6/1960 | Schramm | 166/117.5 |
| 3,052,309 | 9/1962 | Eastman | 166/117.5 |
| 3,827,490 | 8/1974 | Moore, Jr. et al. | 166/117.5 |
| 4,034,806 | 7/1977 | McGinn et al. | 166/117.5 |
| 4,368,780 | 1/1983 | Merritt | 166/117.5 |

*Primary Examiner*—Ernest R. Pursuer
*Assistant Examiner*—Thuy M. Bui
*Attorney, Agent, or Firm*—Albert W. Carroll

[57] ABSTRACT

A side pocket mandrel having an orienting sleeve therein with improved guide surfaces for more reliably orienting a kickover tool with respect to the mandrel preparatory to installing a flow control device in or removing such a device from the mandrel's offset receptacle bore.

8 Claims, 10 Drawing Figures

SIDE POCKET MANDREL WITH IMPROVED ORIENTING MEANS

BACKGROUND OF THE INVENTION

1. Field of the Invention

This invention relates to gas lift apparatus and more particularly to side pocket mandrels for use in gas lift wells.

2. Description of the Prior Art

Side pocket mandrels with orienting means therein for orienting a kickover tool used in installing well flow control devices in or removing them from their offset receptacles have been used for many years. Side pocket mandrels and kickover tools therefor have been supplied by a number of suppliers in the industry. Kickover tools from one supplier may not work well in the side pocket mandrels of another supplier even though such kickover tool may have been intended for use in such side pocket mandrel. It has been desirable to provide a side pocket mandrel which would be compatible with virtually any kickover tool designed for use with such mandrel and to minimize difficulties arising from such mismatching.

The orienting means in side pocket mandrels have been in the form of a sleeve surrounding the bore through the side pocket mandrel, this sleeve being provided with a pair of symmetrical guide surfaces generally helical in shape leading from a point at the lower end of the sleeve upwardly to the lower end of a longitudinal orienting slot. In some cases where the sleeve provides orientation only, this slot may pass completely through the sleeve. In other mandrels the slot may be provided with a shoulder, and in some cases this shoulder completely blocks the slot. Such shoulder at the upper end of the slot is utilized in activating a kickover tool after it has first been oriented.

Kickover tools of the orienting type are provided with an orienting key sufficiently narrow to enter the orienting slot in the orienting sleeve and have an abrupt upwardly facing shoulder thereon. When this abrupt shoulder engages the orienting sleeve, it will follow one of the guide surfaces causing the kickover tool to rotate about its longitudinal axis until the key becomes aligned with and enters the slot, thus orienting the kickover tool with respect to the side pocket mandrel, that is, positioning the kickover tool for installing a device in the offset receptacle of the side pocket mandrel. In some cases, as where wireline equipment is used, the same abrupt shoulder of the orienting key also engages the shoulder in the slot, and further movement of the kickover tool causes it to be activated such that a portion thereof is shifted laterally into alignment with the offset receptacle of the side pocket mandrel.

Kickover tools are commonly run into wells and removed therefrom by conventional wireline equipment or by conventional pumpdown operations. In the latter, the kickover tool and a string of pumpdown tools including piston units are moved by fluid pressure into and out of the well by circulation of fluids through the well. Whether the kickover tool is run by wireline or by pumpdown methods, it is sometimes difficult to control the velocity of the kickover tool with respect to the side pocket mandrel. Thus, it often occurs that the kickover tool moves through the side pocket mandrel at excessive velocities. This may be due to the drag of the tools in the well tubing during pumpdown operations and also due to the fluid bypass through the kickover tool.

These may cause the tools to lodge momentarily in tight places in the tubing and then move quickly until stabilization occurs and normal velocity is restored. Similarly, in wireline operations (the wireline being elastic), such a condition can occur. This condition can be further aggravated where the wireline reel is mounted on a floating vessel which tosses about on the water's surface relative to the well which is stationary with the earth. When the kickover tool moves too fast relative to the side pocket mandrel, its orienting key may fail to enter the slot of the orienting sleeve. One particular type or orienting key has failed frequently and caused considerable difficulty. When this type of key engages one of the guide surfaces on an orienting sleeve while the kickover tool is moving rapidly with relation thereto, considerable rotational force is applied to the kickover tool. In such case, the orienting key may strike the juncture of the opposite guide surface and the opposite wall of the slot in such manner that it causes the orienting key to retract momentarily and pass through the sleeve without ever orienting the kickover tool.

The present invention overcomes such difficulty in a manner which will be hereinafter explained.

A search of the prior art was made, and the following U.S. patents were located, each of which illustrates an orienting sleeve in a side pocket mandrel.

| | | |
|---|---|---|
| 2,942,671 | 3,807,498 | 4,034,806 |
| 2,948,341 | 3,827,489 | 4,051,895 |
| 3,353,607 | 3,827,490 | 4,066,128 |
| 3,581,818 | 3,837,398 | 4,103,740 |
| 3,610,336 | 3,874,445 | 4,106,563 |
| 3,727,683 | 3,876,001 | 4,106,564 |
| 3,732,928 | 3,889,748 | 4,135,576 |
| 3,741,299 | 3,891,032 | 4,146,091 |
| 3,741,303 | 3,965,979 | 4,197,909 |
| 3,752,231 | 4,002,203 | 4,239,082 |
| 3,788,397 | 4,031,954 | 4,271,902 |
| 3,796,259 | 4,033,409 | 4,294,313 |

Included in the above list are three patents which are considered exemplary of the types of side pocket mandrel orienting sleeves of which the present invention is an improvement. The list also includes a fourth patent which illustrates and describes a kickover tool having an orienting key of the type which has been associated with the failures discussed hereinabove.

U.S. Pat. No. 2,942,671 which issued to Harry B. Schramm on June 28, 1960 discloses a side pocket mandrel with an orienting sleeve therein, the orienting sleeve having a pair of guide surfaces which lead to a longitudinal orienting slot which passes completely through the sleeve.

U.S. Pat. No. 2,948,341 which issued to John V. Fredd on Aug. 9, 1960 discloses a side pocket mandrel having an orienting sleeve therein which is provided with guide surfaces leading to a longitudinal orienting slot which passes completely through the sleeve, but the sleeve is further provided with shoulder means located in the slot.

U.S. Pat. No. 3,827,490 which issued to Howard H. Moore, Jr. and Harold E. McGowan, Jr. on Aug. 6, 1974 discloses a side pocket mandrel having an orienting sleeve therein having a pair of guide surfaces leading to an orienting slot and a trip shoulder at the end of the slot which completely blocks the slot. These three patents are typical of the types of orienting sleeves which are disclosed in the other patents listed above.

U.S. Pat. No. 3,876,001 which issued to William B. Goode on Apr. 8, 1975 illustrates and describes a kickover tool for use in side pocket mandrels which are equipped with orienting sleeves such as that just mentioned with respect to U.S. Pat. No. 3,827,490. This kickover tool is equipped with an orienting key having a portion thereof protruding from a window and presenting cam surfaces which would tend to cam the key inwardly toward retracted position when meeting with obstructions in the well tubing. This key has an upwardly opening radial slot at its upper end and has a filler piece pivotally mounted in the slot. This filler piece is shear-pinned in place to releasably hold it in the position shown, in which position the filler piece presents an abrupt upwardly facing shoulder to engage the guide surfaces and trip shoulder of an orienting sleeve. Upon shearing the shear pin, the filler piece becomes inoperative, and the key will thereafter pass shoulders or obstructions with readiness because of the key's cam surfaces mentioned earlier camming the key toward retracted position upon encountering obstructions in the well tubing.

There was not found in the prior art patents a side pocket mandrel having a longitudinal orientation slot and a pair of guide surfaces therebelow directed upwardly toward the lower end of the slot but intersecting the slot at different levels which are spaced apart longitudinally. Neither was there found a side pocket mandrel having an orienting sleeve with a longitudinal orientation slot therein and a single guide surface therebelow directed upwardly toward the lower end of the slot from a point at the lower end of the orienting sleeve via a helical path and making substantially a full revolution before intersecting the slot.

The present invention overcomes the problems and shortcomings discussed hereinabove by providing side pocket mandrels having orienting sleeves therein with guide surfaces of a novel form which eliminate malfunctioning as described above and thus saves much time and money.

SUMMARY OF THE INVENTION

The present invention is directed to side pocket mandrels having orienting means therein comprising an orienting sleeve having an orienting slot and a pair of guide surfaces below the slot and directed upwardly toward the slot, these two guide surfaces having their upper ends spaced apart longitudinally with respect to the longitudinal axis of the orienting sleeve. In one aspect of the invention, the orienting sleeve has but a single guide surface.

It is therefore one object of this invention to provide a side pocket mandrel having an orienting sleeve therein, the sleeve having an orienting slot and a guide surface below the slot leading upwardly to the bottom of the slot for orienting a kickover tool in the mandrel with respect to its offset receptacle bore.

Another object of this invention is to provide such a side pocket mandrel with an orienting sleeve therein having an orienting slot and a pair of guide surfaces below the slot directed upwardly toward the bottom of the slot, the two guide surfaces having their upward ends spaced apart longitudinally.

Another object is to provide a side pocket mandrel having an orienting sleeve with a slot therein and a pair of guide surfaces directed upwardly toward the bottom of the slot, these two guide surfaces being helical in form and having unequal helix angles.

Another object of the invention is to provide a side pocket mandrel with such an orienting sleeve wherein the two guide surfaces extend upwardly from a point which is angularly displaced from the location of the orienting slot by approximately 90 degrees.

Another object of this invention is to provide side pocket mandrels of the character just described wherein there is provided a stop shoulder in the orienting slot of the orienting sleeve for activating a kickover tool.

Another object is to provide side pocket mandrels of the character described wherein the stop shoulder completely blocks the slot in the orienting sleeve.

Another object of this invention is to provide a side pocket mandrel of the character described having an orienting sleeve located above the belly in the side pocket mandrel.

Another object of this invention is to provide side pocket mandrels of the character described having an orienting sleeve positioned below the upper end of the offset receptacle.

Other objects and advantages will become apparent from reading the description which follows and from studying the accompanying drawings wherein:

DESCRIPTION OF THE PREFERRED EMBODIMENTS

Figure 1A:
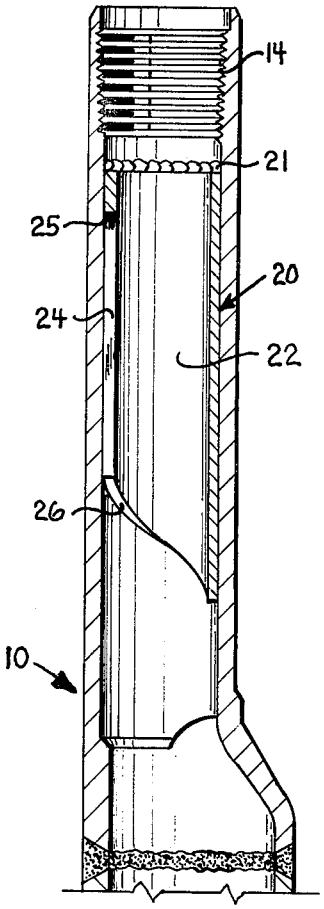
FIGS. 1A and 1B taken together constitute a longitudinal sectional view of a side pocket mandrel constructed in accordance with the present invention and showing an orienting sleeve near its upper end.
Figure 2:
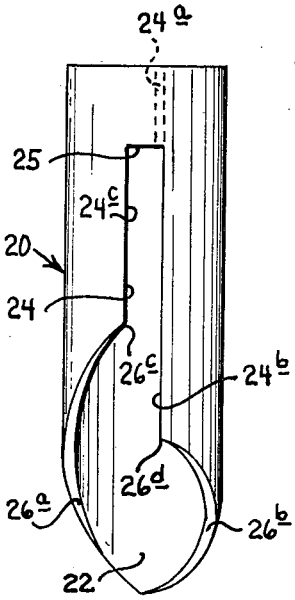
FIG. 2 is a side elevational view of an orienting sleeve constructed in accordance with this invention.
Figure 1B:
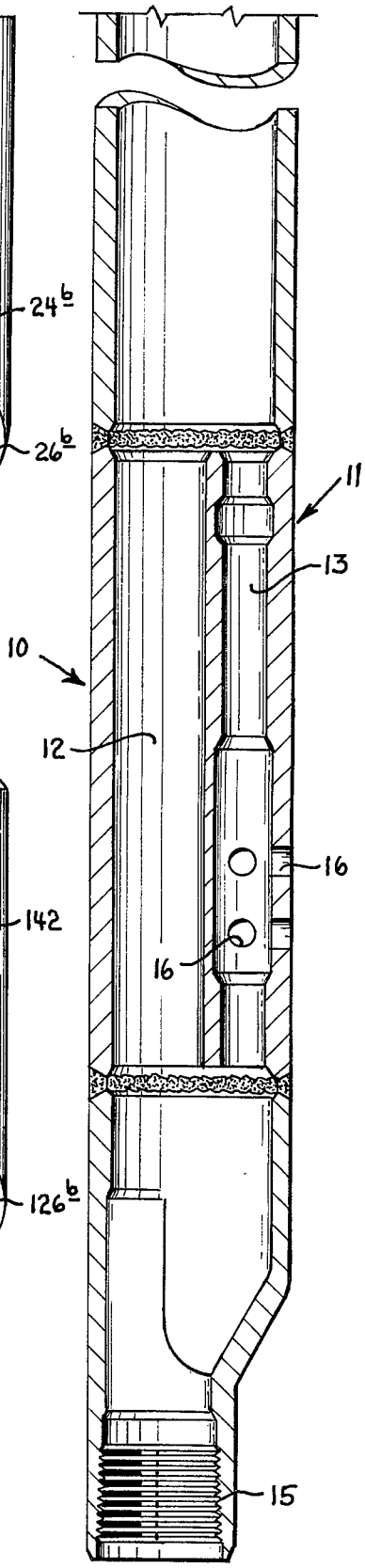

Referring now to FIGS. 1A, 1B and 2, it will be seen that the side pocket mandrel is indicated generally by the numeral 10. This mandrel for illustration purposes is constructed generally according to the application of Higgins and Merritt, filed May 12, 1980, Ser. No. 148,928, now U.S. Pat. No. 4,333,527. It is thus shown provided with a welded body 11 having a full-opening bore extending therethrough from end to end and an offset receptacle bore 13 extending alongside the main bore 12 and with means at its upper and lower ends as at 14 and 15 for attachment to a string of well tubing. Lateral flow ports 16 communicate the receptacle bore 13 with the exterior of the mandrel in the well-known manner. Near its upper end, the mandrel is provided with an orienting sleeve 20 which is welded in place as at 21, and this sleeve has a bore 22 which surrounds the main bore 12 through the mandrel. The orienting sleeve 20 is provided with a longitudinal orienting slot 24 having a downwardly facing shoulder 25 at the upper end thereof which may or may not completely block the slot. Sleeve 20 is further provided with a pair of downwardly facing guide surfaces 26 which are directed upwardly toward the lower end of the slot 24, and these guide surfaces are engageable by an orieting key of a kickover tool (not shown). The guide key upon engaging one of the guide surfaces will follow it causing the kickover tool to rotate abouts its longitudinal axis until its orienting key becomes aligned with and enters the orienting slot. When the orienting key is in the orienting slot, the kickover tool is properly oriented in the side pocket mandrel with respect to the receptacle bore 13.

Figure 3:
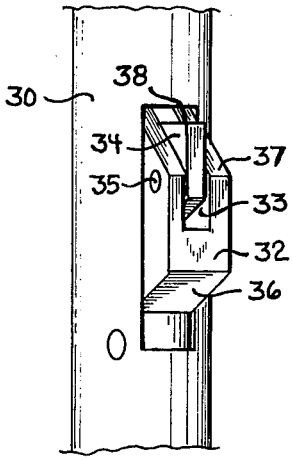
FIG. 3 is a fragmentary side elevational view showing a portion of a kickover tool having an orienting key usable with the present invention.

In the past, the two guide surfaces on orienting sleeves have been symmetrical, that is, they have been equal in length, and if helical, have had equal helix angles. In each case, their upper ends have intersected the slot on a common level. Such orienting sleeves worked well with most kickover tools, however, when kickover tools having a certain type of key were used, it was often necessary to make several trips through the side pocket mandrel before orientation of the kickover tool was achieved. Such a kickover tool is partially illustrated in FIG. 3, which see. In FIG. 3, the kickover tool is generally indicated by the numeral 30, and the orienting key is indicated by the numeral 32. The orienting key 32 is bifurcated at its upper end, being provided with an upwardly opening slot 33 in which is disposed a filler piece 34 releasably held in the position shown by a shear pin 35. The orienting key is beveled at its lower end 36 for guiding the key past obstructions as the kickover tool is lowered in the well and is similarly beveled at its upper end as at 37 for guiding the key past obstructions during upward travel of the kickover tool in the well. When the filler piece 34 is in the pinned position shown, its upper end 38 provides an abrupt upwardly facing shoulder on the key which will engage one or the other of the guide surfaces 26 on the sleeve 20 and will follow the guide surface thus causing the kickover tool to operate about its longitudinal axis until the key becomes aligned with the orienting slot 24 and moves upwardly therein.

When the orienting key 32 reaches the upper end of the slot, its filler piece 34 engages the shoulder 25, the filler piece 34 being held in operating position by the shear pin 35. Thus, upward movement of the orienting key 32 is arrested, and further upward movement of the kickover tool will cause relative longitudinal movement between the orienting key and the kickover tool and cause the kickover tool to be activated. With the orienting key in the orienting slot, the kickover tool is correctly oriented with respect to the offset receptacle bore 13, and the kickover tool can be operated to install a device therein or remove a device therefrom. Afterwards, it is necessary to withdraw the kickover tool from the side pocket mandrel. For this operation the kickover tool is lifted again until the filler piece 34 engages the downwardly facing shoulder 25 in the orienting sleeve and sufficient force applied thereto to cause pin 35 to shear allowing the filler piece 34 to rotate about a pivot pin (not shown) to its inoperative position within the key 32. With the filler piece 34 out of the way, the beveled surface 37 at the upper end of the orienting key 32 becomes effective to guide the orienting key past any downwardly facing obstructions such as the downwardly facing shoulder 25 at the upper end of the slot in the orienting sleeve 20, and the kickover tool may thus be withdrawn from the well without difficulty. If the guide surfaces on an orienting sleeve have their upper ends terminate at a common level, as is the case with the prior art devices, and the orienting key of the kickover tool engages one of them at considerable speed, the sudden cam action of the key and guide surface will impart considerable rotational force to the kickover tool and rotate it about its longitudinal axis with considerable angular velocity. This may cause cam surface 37 on the orienting key to strike the far side of the slot at about the juncture of the slot with the opposite guide surface and cause the key to be cammed inwardly allowing it to enter the bore of the sleeve and thus pass through the sleeve without orienting the kickover tool and without the filler piece 34 ever contacting the downwardly facing shoulder at the upper end of the slot. Such difficulty happens with considerable frequency, and in some cases it is very difficult to achieve proper orientation and activation of the kickover tool at all.

It will be noticed in the FIG. 2 that the orienting sleeve 20 of this invention has a bore 22 and is provided with a longitudinally directed orientation slot 24. Near the upper end of the sleeve a downwardly facing shoulder 25 is located in the slot. The shoulder 25 may completely block the slot as shown, or if desired, a narrow slot similar to slot **24*a* can extend from the shoulder to the upper end of the sleeve as shown in dotted lines. A pair of guide surfaces 26*a* and 26*b* are formed on the lower end of the sleeve, and both are directed upwardly toward the bottom of the slot 24**.

It will be noticed that the guide surface **26*a* is longer than the guide surface 26*b*. It may be preferable for these guide surfaces to be helical and to have different helix angles. Guide surface 26*a* intersects the slot at the higher position than does the guide surface 26*b* so that the two places of intersection, 26*c* and 26*d***, are spaced apart longitudinally relative to the longitudinal axis of the orienting sleeve. This displacement in most cases will be somewhere near two inches for common sizes of side pocket mandrels.

When a kickover tool such as the kickover tool 30 having a key such as the orienting key 32 thereon approaches the orienting sleeve 20, as when the kickover tool would be lifted through the side pocket mandrel 10, the top end 38 of the filler piece 34 of the key will, in all likelihood, engage one of the guide surfaces **26*a*, and the kickover tool will be rotated in a counterclockwise direction as seen from the top of the sleeve until the key 32 enters the slot 24. When the kickover tool is lifted further, the filler piece 34 engages the downwardly facing shoulder 25 at the top of the slot 24, the key 32 is stopped, and further movement of the kickover tool may be utilized to bring about relative longitudinal movement between the key and the kickover tool in order to activate the kickover tool in the well-known manner. When the kickover tool is passing through the orienting sleeve 20 at considerable rate of speed and the filler piece 34 of the key engages the guide surface 26*a*, rapid rotation to the kickover tool occurs, and the momentum causes the kickover tool to tend to rotate past the slot. It will clearly be seen that in such case the key will strike the right-hand wall 24*b* of the slot, and this rotation of the tool will be stopped allowing the key to then enter the slot. Since the filler piece at this time would be above the point 26*d* at which the right-hand wall of the slot 24*b* is intersected by the right-hand guide surface 26*b*, there is no chance that the key 32 will be cammed inwardly and cause the key to fail to engage the shoulder 25** at the top of the slot.

In similar but different manner, when the kickover tool is lifted at considerable velocity through the side pocket mandrel and the filler piece 34 of the key 32 engages the guide surface **26*b* of the orienting sleeve, the kickover tool will be rotated rapidly clockwise. When the key reaches the upper end of the guide surface 26*b*, the momentum will cause the kickover tool to tend to rotate past the slot, but in any event the filler piece 34 of the key 32 should engage the guide surface 26*a* on the left-hand side of the orienting sleeve as seen in FIG. 2, and the guide surface 26*a* should then rotate the kickover tool back in the other direction. This time, should the momentum of the kickover tool cause the same to rotate with any considerable force, the side of the key would then strike the right-hand wall surface 24*b* of the slot above the point 26*d* as before, and further lifting of the kickover tool would cause the key to move upwardly in the slot. It will be noticed that in this case there has been no tendency for the beveled surface 37 at the upper end of the key to strike the point 26*c* at which the guide surface 26*a* intersects the left-hand wall 24*c* of the slot 24**. Thus, the tool should be properly oriented, and there should be little chance that a malfunction in this respect would occur.

Therefore, it has been shown that when a kickover tool such as the kickover tool 30 of FIG. 3 having an orienting key 32 with a filler piece 34 mounted therein is moved upwardly, and the key engages one of the guide surfaces **26*a* or 26*b* of the orienting sleeve, even though the kickover tool is moving at considerable velocity, the key will still enter the slot 24, and the filler piece 34 at the upper end thereof will engage the downwardly facing shoulder 25 at the top of the slot. Laboratory tests have shown that in situations where it was difficult to achieve proper orientation and activation of the kickover tool in the mandrel, replacement of the conventional orienting sleeve having conventional guide surfaces with an orienting sleeve having novel guide surfaces such as shown in FIG. 2** has solved the problem. After changing the conventional sleeve for the sleeve of this invention, it was very difficult to pull the kickover tool therethrough without achieving proper orientation.

Figure 5:
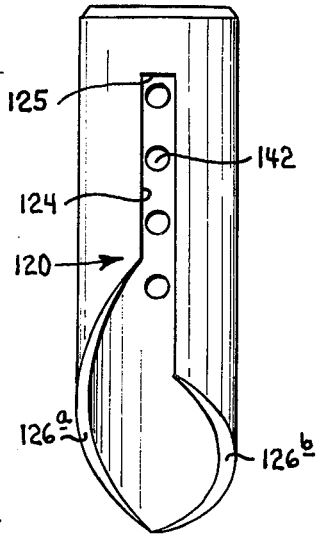
FIG. 5 is a side elevational view of the orienting sleeve which forms a part of the mandrel of FIG. 4B.
Figure 4A:
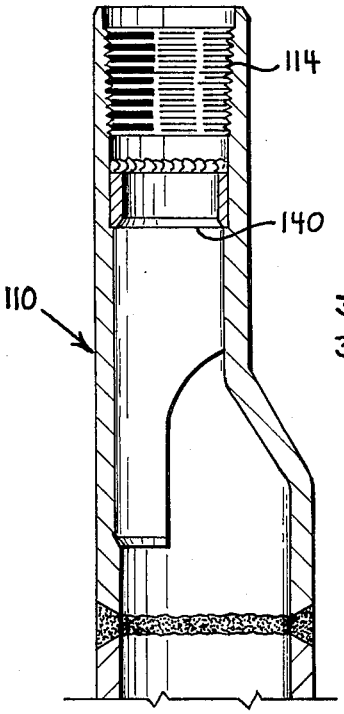
FIGS. 4A and 4B taken together constitute a longitudinal sectional view of a side pocket mandrel constructed in accordance with this invention and having an orienting sleeve therein positioned near its lower end.
Figure 4B:
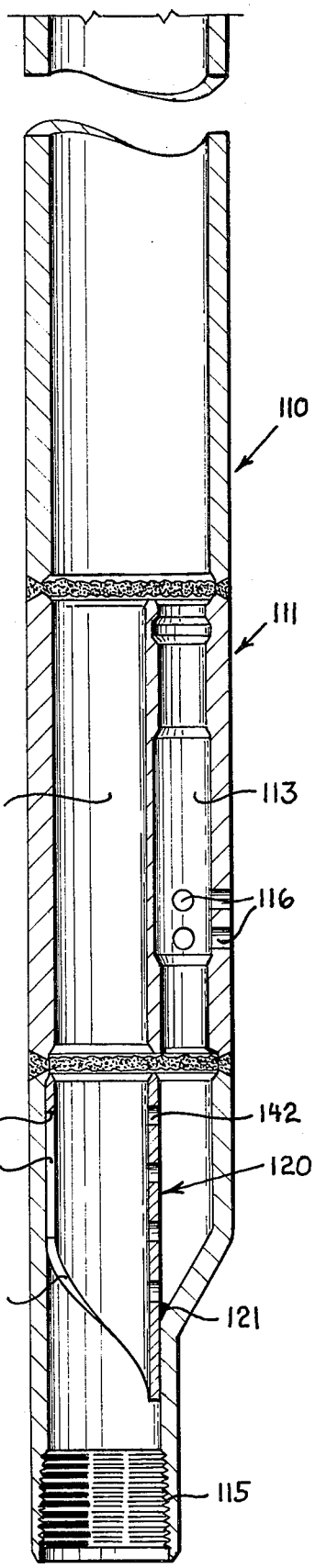

Referring now to FIGS. 4A, 4B and 5, it will be seen that a side pocket mandrel of modified form is provided. Whereas the mandrel 10 of FIGS. 1A and 1B had its orienting sleeve near the top and thus was for use with kickover tools lowered into the well on a wireline, the mandrel 110 of FIGS. 4A, 4B and 5 has its orienting sleeve near the bottom and is intended for use in pumpdown wells where the kickover tool is moved into and out of the well by circulation of fluids through the well. Pumpdown kickover tools are articulated for passage through flow lines having bends therein as sharp as 60-inch radius, and it so happens that it is more practical to place the orienting key at the lower end of the kickover tool and the orienting sleeve near the lower end of the side pocket mandrel.

Mandrel 110 is seen to comprise a body 111 having a full-opening passage 112 extending therethrough from end to end and having a receptacle bore 113 offset from and extending alongside the main full-open bore 112. Connection means are provided at the upper and lower ends of the mandrel as at 114 and 115 for attachment to a string of well tubing to become a part thereof. Lateral ports such as ports 116 are provided in the wall of the body at the receptacle bore 113 to communicate the bore 113 with the exterior of the mandrel. An orienting sleeve 120 is welded as at 121 into the lower portion of the mandrel as seen in the drawing so that it surrounds the main passage 112. The orienting sleeve 120 is provided with a longitudinally directed orientation slot 124, and this slot may pass completely through the sleeve or may terminate with a cam shoulder such as cam shoulder 152 which is inclined inwardly and upwardly as shown in FIG. 4B. Although the upper end of the pumpdown kickover tool key will not be beveled at its upper end like the key 32, the cam shoulder 125 will cam this key inwardly and will allow the key to pass through the orienting sleeve in the well-known manner. Below the slot 124, the orienting sleeve is provided with guide surfaces **126*a* and 126*b* which are not unlike guide surfaces 26*a* and 26*b* of sleeve 20 previously described and are directed upwardly from the lower end of the sleeve toward the lower end of the slot. Either of the guide surfaces 126*a* or 126*b* is of course engageable by the orienting key and will impart thereto a cam action resulting in rotational movement to the kickover tool to cause the kickover tool to rotate about its longitudinal axis as it is moved through the mandrel in order to bring the orienting key into alignment with the orienting slot. When the orienting key is in the orienting slot, the kickover tool is positioned in the side pocket mandrel so that it is properly aligned with respect to the offset receptacle bore 113. A pumpdown type kickover tool as presently known is not activated by the orienting key striking a shoulder at the upper end of the slot. Instead the kickover tool (not shown) is provided with separate releasable locating means at its upper end which engages a downwardly facing shoulder such as shoulder 140** near the upper end of the side pocket mandrel. This type of kickover tool is illustrated and described in U.S. Pat. No. 3,837,398 which issued Sept. 24, 1974 to John H. Yonker.

It will be noticed that the orienting sleeve 120 of the mandrel 110 is provided with one or more ports 142 through the wall thereof which communicate the interior of the sleeve with the exterior of the mandrel through the lower end of the receptacle bore 113 and the lateral ports 116.

It will be seen in FIG. 5 that the guide surfaces **126*a* and 126*b* of sleeve 120 are related to the orienting slot 124 in exactly the same way and perform exactly the same functions as the corresponding guide surfaces 26*a* and 26*b* of the orienting sleeve 20 shown in FIG. 2 and before explained. These guide surfaces 126*a* and 126*b* intersect the slot 124 at points spaced apart longitudinally and cooperate with the orienting key of a kickover tool in the side pocket mandrel with much greater reliability even though the kickover tool be moved through the mandrel at relatively high velocity. After the pumpdown kickover tool has been oriented and activated and has done kits work, the kickover tool is lifted with respect to the side pocket mandrel. This causes it locating means at its upper end to again engage the downwardly facing shoulder 140** near the upper end of the side pocket mandrel. A greater force is now applied thereto than was applied earlier, causing this mechanism to release and permitting the kickover tool then to be lifted out of the mandrel and withdrawn from the well.

Both of the orienting sleeves thus far discussed have been provided with a pair of guide surfaces which have been unequal in length and having their upper ends intersect the orienting slot at different levels, that is, at levels that are displaced longitudinally from one another with respect to the longitudinal axis of the sleeve and both of the guide surfaces have come together at their lower ends to form a point. As was mentioned, the two guide surfaces are of unequal length and preferably different helix angles. The two guide surfaces, however, could be of different lengths and yet have equal helix angles in which case the point at the lower end of the sleeve would be displaced angularly with respect to the slot. This, however, may not be as desirable as having unequal helix angles as the sleeves in FIGS. 2 and 5 appear to have, but if it is desired to provide a point which is displaced angularly from the slot by something other than 180 degrees, this can be done, and such a sleeve is shown in FIGS. 6 and 7.

Figure 6:
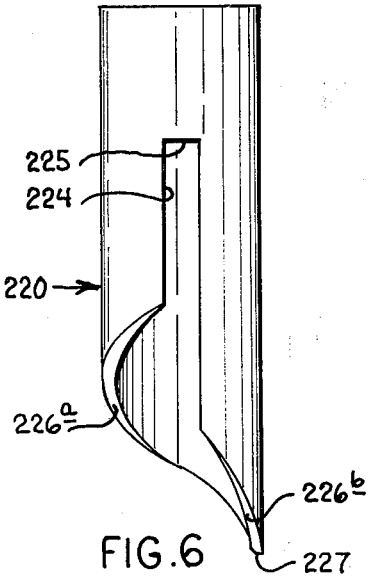
FIG. 6 is a side elevational view of a modified form of orienting sleeve.
Figure 7:
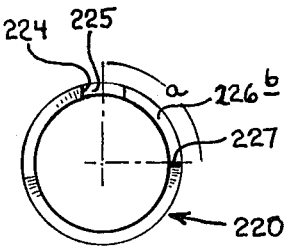
FIG.7 is a lower end view of the orienting sleeve of FIG. 6.

In FIGS. 6 and 7 orienting sleeve 220 is seen to have an orienting slot 224 and a trip shoulder at the upper end of the slot. A pair of guide surfaces 226*a* and 226*b* are directed upwardly towards the bottom of the slot from a point 227. The point 227 is shown in FIG. 7 to be angularly displaced from the slot 224 by an angle which is shown for illustration purposes to be approximately 90 degrees. The point 227 could as well be displaced some other amount, but in most cases and for practical reasons, the point would be preferred to be either 180 degrees or 90 degrees approximately from the slot.

The orienting sleeve 220 is shown formed with the guide surface 226*b* having a considerably greater lead than the lead of guide surface 226*a*.

Figure 8:
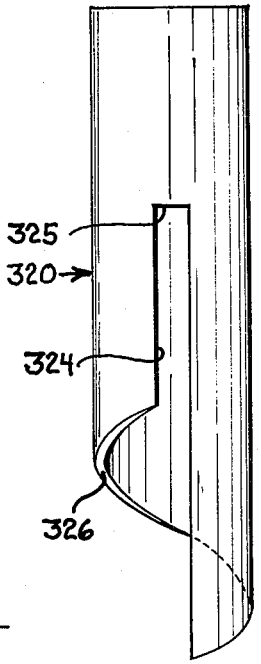
FIG. 8 is a side elevational view of a further modified form of orienting sleeve.

It is possible to provide an orienting sleeve having only a single guide surface, and such sleeve is illustrated in FIG. 8. Here the guide sleeve 320 has an orientation slot 324 and a trip shoulder 325 at the upper end of the slot. The sleeve has a single guide surface 326 below the slot but directed upwardly toward the lower end of the slot. In this case, the guide surface makes almost a full revolution, and of course the shape of the guide surface is shown to be helical, this being the most practical form.

An orienting sleeve such as the sleeve 320 shown in FIG. 8 will perform quite commendably, but it may not be the most practical in design. It will be noticed that the lower end of the orienting sleeve 320 terminates with a rather sharp point, and this point may be more readily damaged since impacting a kickover tool against it may cause upsetting of the metal. It will be noticed, too, that if such a sleeve is formed with a helical guide surface such as guide surface 326, the distance from the top of the slot to the bottom end of the sleeve is twice what it would be with a conventional type orienting sleeve having two symmetrical guide surfaces. Thus, the sleeve is longer than it ideally needs to be, and since most mandrels are designed so that they are about short as can be and still be practical, such a sleeve as orienting sleeve 320 just may be simply too long, and a sleeve such as that shown in FIG. 2 or in FIG. 6 may be preferred by most operators.

Thus it has been shown that the side pocket mandrels and orienting sleeves illustrated and described herein fulfill all of the objects of the invention set forth at the beginning of this application.

The foregoing description and drawings of the invention are explanatory and illustrative thereof, and various changes in sizes, shapes, materials and arrangement of parts, as well as certain details of the illustrated construction, may be made within the scope of the appended claims without departing from the true spirit of the invention.

I claim:

1. An improved orienting-type side pocket mandrel, including:

a. elongate body means having a main passage therethrough;

b. connecting means on opposite ends of said body means for attachment to a string of well tubing;

c. receptacle bore means in said body means offset from and extending alongside said main passage for receiving a flow control device;

d. port means in said body means communicating said receptacle bore means with the exterior of said mandrel;

e. offset belly means in said body means above said receptacle bore means providing space for operation of a handling tool for installing a device in said receptacle bore means; and f. an orienting sleeve in said body means for orienting said handling tool relative to said receptacle bore means, said orienting sleeve having:

i. a longitudinally extending orienting slot therein, and ii. a pair of guide surfaces below said slot and directed upwardly toward the bottom of said slot, said pair of guide surfaces having their upper ends longitudinally spaced apart.

2. The mandrel of claim 1, wherein the guide surfaces on said orienting sleeve are unequal in length.

3. The mandrel of claim 2, wherein the guide surfaces on said orienting sleeve are helical and have unequal helix angles.

4. The mandrel of claim 2, wherein the lower ends of said guide surfaces of said orienting sleeve converge at a point angularly displaced from said slot by approximately 90 degrees.

5. The mandrel of claim 1, 2, 3 or 4, including a stop shoulder in said orienting slot for stopping said handling tool for activating said handling tool.

6. The mandrel of claim 5, wherein said stop shoulder completely blocks said orienting slot.

7. The mandrel of claim 5, wherein said orienting sleeve is located in said body means above said offset belly means.

8. The mandrel of claim 1, 2, 3 or 4, wherein said orienting sleeve is located in said body means below the upper end of said receptacle bore means.

* * * * *